US006750385B1

(12) United States Patent
Sugden

(10) Patent No.: US 6,750,385 B1
(45) Date of Patent: Jun. 15, 2004

(54) STRINGED MUSICAL INSTRUMENT

(75) Inventor: David Burnet Sugden, Kingston Beach (AU)

(73) Assignee: Gondwana Musical Instrument Company Pty Ltd. (AU)

( * ) Notice: Subject to any disclaimer, the term of this patent is extended or adjusted under 35 U.S.C. 154(b) by 0 days.

(21) Appl. No.: 09/700,819

(22) PCT Filed: May 20, 1999

(86) PCT No.: PCT/AU99/00378

§ 371 (c)(1),
(2), (4) Date: Nov. 20, 2000

(87) PCT Pub. No.: WO99/62050

PCT Pub. Date: Dec. 2, 1999

(30) Foreign Application Priority Data

May 21, 1998 (AU) ..... PP 3616

(51) Int. Cl.[7] ..... G10D 1/02
(52) U.S. Cl. ..... 84/274; 84/290
(58) Field of Search ..... 84/290, 267, 274

(56) References Cited

U.S. PATENT DOCUMENTS 1,329,594 A * 2/1920 Going
1,364,217 A * 1/1921 Surratt
1,701,809 A * 2/1929 Jerome ..... 84/274
2,449,124 A * 9/1948 Kimmons ..... 84/267
2,457,629 A * 12/1948 Beckman ..... 84/275
4,286,494 A * 9/1981 Jaquith ..... 84/309
5,734,117 A * 3/1998 Tanzella ..... 84/309

FOREIGN PATENT DOCUMENTS

WO WO86/04713 * 8/1986

* cited by examiner

*Primary Examiner*—Kimberly Lockett
(74) *Attorney, Agent, or Firm*—Wolf, Greenfield & Sack, P.C.

(57) ABSTRACT

An assembly (10) for a stringed musical instrument, the assembly (10) including an elongate neck (11) to which one end of a string arrangement (41) of the instrument can be anchored and a structural member (17) depending from the neck (11). The structural member (17) being substantially aligned with the lengthwise extent of the neck (11) and extending in the opposite direction thereto so as to overlie a sound box to which in use, the assembly (10) is connected. The structural member (17) is arranged to cooperate with and to bear string tension load of the string arrangement (14) applied to the assembly (10). A bridge (30) for a stringed musical instrument, which bridge (30) includes first and second parts (31, 32) which are pivotable relative to one another.

24 Claims, 4 Drawing Sheets

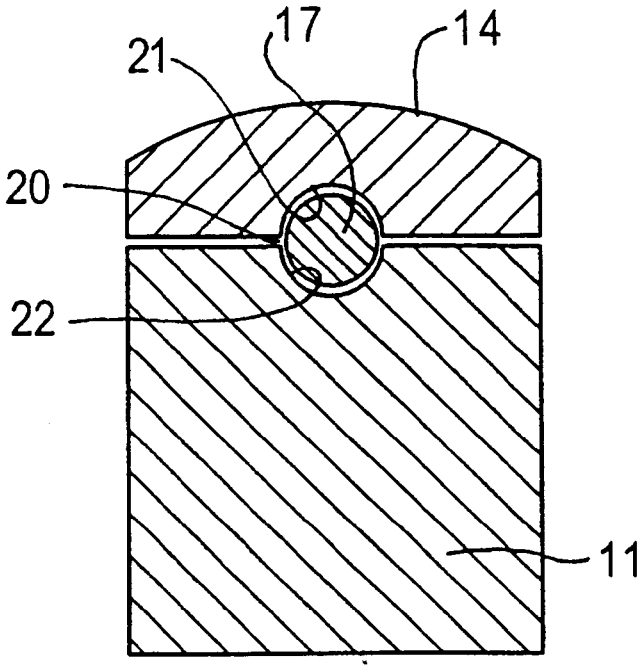
FIG 3
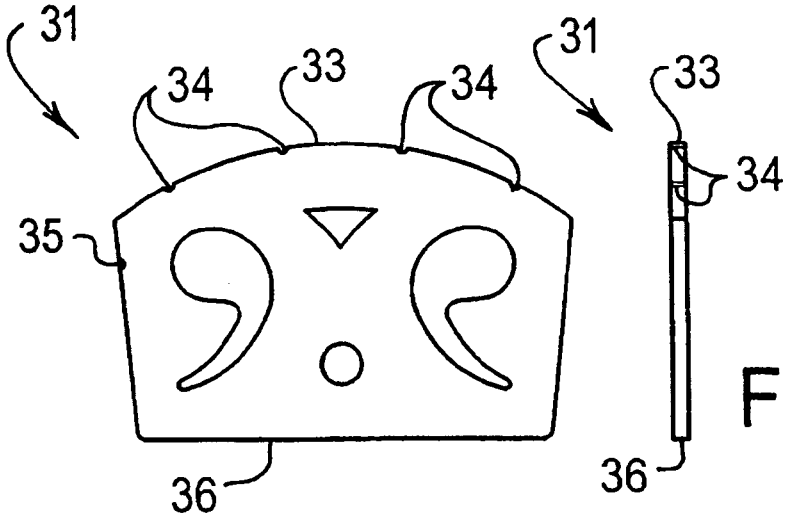
FIG 4b
FIG 4a

STRINGED MUSICAL INSTRUMENT

This invention relates to musical instruments of the stringed kind. By way of example, the invention is applicable to musical instruments such as the violin, viola, cello, bass, guitar and mandolin. It will be convenient, however, to hereinafter describe the invention with particular reference to violins.

Violin manufacture is a highly specialised art requiring the use of special timbers and the application of special skills which require many years to achieve. As a consequence, the violins of only a few manufacturers are recognised as satisfactory for use by concert musicians, and those violins are extremely expensive. Even violins of lesser quality, however, are expensive because of the care and time involved in their manufacture.

The quality of sound derived from a particular violin is largely dependent on the skill with which certain components have been manufactured and installed, as well as the materials chosen for their manufacture. A violin, as well as the majority of other instruments to which the invention relates, includes a sound box, which, amongst other components, includes top and bottom plates. Due to the construction of the traditional violin, the sound box is subjected to tensile and compressive load, and bending loads, and the top and bottom plates are forced to move in a very complex manner when activated by the strings of the instrument and all of this movement contributes to the sound quality of the instrument. For this reason, correct selection of the timber used in the manufacture of those plates is very critical. The standard manufacturing dimensions of violins have been perfected over a period of 400 years and those dimensions apply to produce satisfactory results only if a timber of a very specific kind is used. The type of timber has always been in limited supply, but it is now becoming increasingly difficult to secure and that which is available is often of poor quality or inadequately seasoned. It is also very expensive.

Stringed musical instruments of the kind to which the invention relates also include a bridge support for the strings, that supports the strings above the sound box. Traditionally, a bridge is formed from timber and includes decorative carvings and/or cutouts. Traditional bridges further include a pair of feet which are fashioned to sit flush against the top surface of the top plate and are held in position against that surface by the string tension, which imposes a downward force on the bridge towards the top plate. Vibration from the strings is transmitted through the feet of the bridge to the top plate which moves in response to the vibrations and it is normal for one of the feet of the bridge to be positioned over a sound post, which is located inside the sound box extending between the top and bottom plates thereof, so that vibration is also transmitted to the bottom plate.

In a typical construction of a bridge, the feet have a relatively broad engagement area with the top plate, and that broad engagement area, along with the string tension force pressing the feet into engagement with the top plate, tends to prevent relative movement between the feet and the top plate. The bridge however, can undergo movement under the influence of loads experienced for example, when the tension of one or more of the strings is altered for tuning purposes, or as a result of downward pressure exerted by a bow on one or more strings, and that movement is generally a bending movement. The bending movement can affect the transmission of string vibration through the bridge, and in extreme cases, the bridge can fail. Accordingly, most bridges are constructed to have a gradually diminishing thickness from adjacent the feet to the top, string supporting edge and in this manner, bending movement of the bridge can be minimised, because a substantial portion of the bridge can be of a thickness suitable to resist the forces that promote such bending, while still retaining acceptable sound quality because the critical portions of the bridge, ie. adjacent the string supporting edge, are maintained at a thickness that vibrate sufficiently under string activation. Bridges of this kind however, are not generally good transmitters of high frequency vibrations, which are desirable for high quality sound, and are still subject to some bending, albeit reduced.

It is an object of the present invention to provide a stringed musical instrument that produces reasonable to higher quality sound, which may be manufactured at a significantly reduced costs compared to instruments manufactured by traditional methods and which enables the use of materials of a less expensive nature than those traditionally used. A further object of the invention is to provide an assembly for a stringed musical instrument that facilitates releasable attachment of a sound box thereto, so that sound boxes of different quality can be attached to the assembly. A still further object of the invention is to provide a bridge which can be manufactured to produce reasonable to high quality sound at reduced cost compared to traditional bridges.

According to the present invention there is provided an assembly for a stringed musical instrument, said assembly including an elongate neck to which one of a string of the instrument can be anchored and a structural member depending from said neck, said structural member being substantially aligned with the lengthwise extent of said neck and extending in the opposite direction thereto so as to overlie a sound box to which in use, the assembly is connected, and being arranged to cooperate with and to bear string tension load of a string arrangement applied to said assembly.

The load bearing capacity of the structural member is preferably such as to eliminate or substantially reduce the load on the sound box due to string tension. In such an arrangement, the material from which the sound box is constructed can be chosen with greater emphasis on the musical characteristics required from the instrument and not the mechanical characteristics required to bear the tension load. Thus, a less complex shape can be adopted and less expensive materials can be used in the construction of the sound box while still maintaining a sound quality of acceptable standard.

An instrument according to the invention will typically have a neck which extends from adjacent the sound box to a position at which the strings are anchored. In such an instrument, the structural member preferably extends from the neck to the opposite end of the sound box and is preferably in the form of an elongate member, which extends across the sound box, preferably in a plane substantially parallel to the top plate. The member can be a rod which is solid or tubular and made of any suitable material. It can alternatively take other forms, such as a plurality of rods or struts. Preferably, the member is highly rigid and lightweight, such as a tubular aluminium or plastic construction.

The member can be fixed to the neck in any suitable manner and in one preferred arrangement, an opening is provided to receive a locating portion of the member. That opening may be formed in any suitable manner and conveniently, in an instrument in which a finger board extends along the neck, such as a violin, the opening may be formed between the finger board and the neck. This is particularly convenient in an instrument in which the finger board is formed separately from the neck.

In the above arrangement, the neck is typically set at an angle to the plane of the top plate of the sound box and in that arrangement, the member may also include a locating portion which extends at that angle, relative to the remaining or major portion of the member.

The strings, or a string arrangement, engages the member at a position remote from the neck connection, so as to cause the rod to bear the string tension. A string arrangement may for example, take the form of that typically provided in a violin, in which the ends of the strings remote from the neck are connected, sometimes adjustably, to a tail piece, which is normally made of wood, and which itself is anchored (in a traditional violin) to the sound box by suitable fastening means. In the assembly of the invention, the strings or the string assembly may be directly fastened to the member, or may be fastened to a different part of the assembly or instrument when fully assembled (such as the sound box), but still be in engagement with the member to transfer tension load thereto. Preferably the engagement position is at the distal end of the rod and that end may be suitably configured, or be provided with suitable engagement means for that purpose.

The invention advantageously facilitates an arrangement in which different sound boxes can be releasably attached to the assembly so that assemblies need not be manufactured for a specific sound box. This reduces the overall cost of an instrument. Also, it reduces the cost of maintenance and repair and facilitates adoption of non-traditional materials.

An assembly according to the invention includes a neck and a structural member extending from the neck and defines a position for attachment of a sound box to the assembly. The sound box can be releasably attached to the assembly in any suitable manner and in a preferred arrangement attachment of the sound box to the assembly is facilitated at two positions, the first being adjacent the neck and the second being at a position opposite the neck. The attachment means may take any suitable for, such as threaded fasteners, pins, clips etc.

The assembly may include a bridge for supporting the strings above the sound box and that bridge may be of a traditional kind or of a kind according to the invention. Preferably, the bridge may be partly supported by the structural member, with the arrangement being such as to facilitate transmission of string vibration to the top plate of the sound box. In one form, the assembly is arranged so that the structural member overlies the sound box top plate when the sound box is fitted to the assembly and the bridge is supported on the structural member, with a pair of feet extending from the bridge into contact with the top plate. One of the feet is preferably located over the sound post of the sound box.

In one form, the structural member is an elongate rod and the bridge includes a first component which is fixed to the rod in the longitudinal direction thereof, and a second component which is fixed to the first component in a direction substantially perpendicular thereto. The second component may engage the top plate of the sound box, such as by way of feet extending into that engagement, and may include means to facilitate pivoting movement of a third component which is upstanding from the second component and which includes a string supporting surface. That pivoting movement may be provided by a bridge support according to the invention as hereinafter described.

The present invention further provides a bridge for a stringed musical instrument, said bridge including first and second parts which are pivotable relative to one another.

A bridge of the above kind has several advantages over known bridges. In particular, such a bridge is less prone to bending, because of the available pivotal movement between the two parts. That is, instead of a distortion of the bridge occurring by bending, the two parts can pivot relative to one another while substantially remaining free from bending distortion, so that the bridge is less prone to breakage and vibration transmission through the bridge is relatively undisturbed.

The two parts of the bridge may be integrally formed and may pivot about a pivot region therebetween, such as a region of reduced thickness, but preferably, the parts are separately formed to be assembled together in a manner which facilitates the pivoting movement. In one preferred arrangement, the first of the two parts includes an edge surface for supporting engagement of the instrument strings and, according to conventional construction, that edge surface may include notches or grooves for locating the strings against that surface and may be arcuately formed laterally, relative to the longitudinal direction of the strings. The second of the two parts is arranged to be fixed to the top plate of the second box of the instrument in a permanently or releasably fixed manner and may include feet that engage the top plate in a spaced-apart manner, one of which can be positioned in use, over the sound post which may be located internally of the sound box.

In the above arrangement, the second part can include means to locate the first part pivotably thereto. That locating means can take any suitable form, and in one preferred form, the locating means includes a laterally extending groove for receiving a lower edge of the first part. While additional locating means may also be employed, in this arrangement, the string pressure imposed on the string engaging surface may be sufficient to maintain the lower edge within the groove, so as to maintain the two parts in engagement.

The first part can be formed in any suitable manner, but advantageously, given the reduced need to resist bending by its pivotal engagement with the second part, it can be formed of a substantially constant thickness although it can equally be formed to have varying thickness, if that results in a more desirable sound. As described earlier, the string engaging surface is preferably arcuate, laterally of the longitudinal direction of the instrument strings and that surface preferably extends between opposite side edges that are preferably straight. However, the side edges may be inclined, or alternatively may be curved or otherwise shaped.

As known in the art, the arcuate string engaging surface distributes the strings across the surface at different heights to facilitate contact of the bow with separate strings, while the provision of straight edged sides is considered to provide better string vibration transmission through the first part to the second part, although that may be influenced by the type of strings employed, ie traditional animal gut strings, or steel or synthetic strings.

The first part according to the above arrangement also includes a lower edge extending between the side edges and that edge is preferably straight or includes a relief between the side edges, such as a concave relief. In a preferred arrangement, the lower edge is formed by a pair of feet spaced apart on either side of a concave relief. Formed in this manner, transmission of string vibration can be through the feet, which can be located over the feet of the second part, as may be provided.

The bridge can be formed of any suitable material and the first part can be formed to have a thickness through at least a substantial portion of its height which is substantially reduced compared to known bridges. For example, the first part of the bridge can be formed from plastics, carbon fibre, kevlar, or plywood and can have a thickness to about 1.5 mm. The material chosen and the dimensions in which it is constructed, can be tailored to suit different sound requirements and, when formed separately from the second part, the first part can be formed of a different material to the second part and can be replaced as necessary for changing conditions or particular sound characteristics desired. The second part can be formed from a variety of different materials, such as timber of the traditional kind, or of non-traditional materials, such as plastics.

The attached drawings show an example embodiment of the invention of the foregoing kind. The particularity of those drawings and the associated description does not supersede the generality of the preceding broad description of the invention.

FIG. 1 is a side view of an assembly according to the invention.

FIG. 2*a* is a side view of a structural member according to the invention.

FIG. 2*b* is a plan view of the structural member of FIG. 2.

FIG. 3 is a cross-sectional view taken through III—III of FIG. 1.

FIG. 4*a* shows a front view of part of a bridge according to the invention.

FIG. 4*b* is a side view of the bridge part of FIG. 4*a*.

Figure 7B:
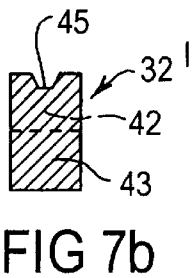
Figure 7A:
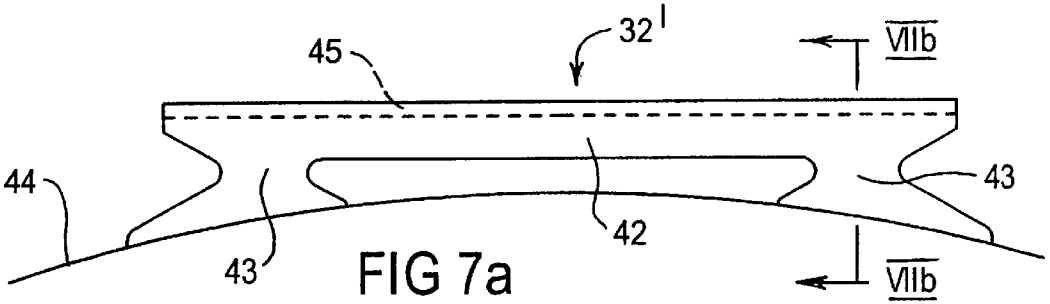

FIG. 7*a* is a front view of a traditional bridge part.

FIG. 7*b* is a side view of the bridge part of FIG. 7*a*.

Figure 8:
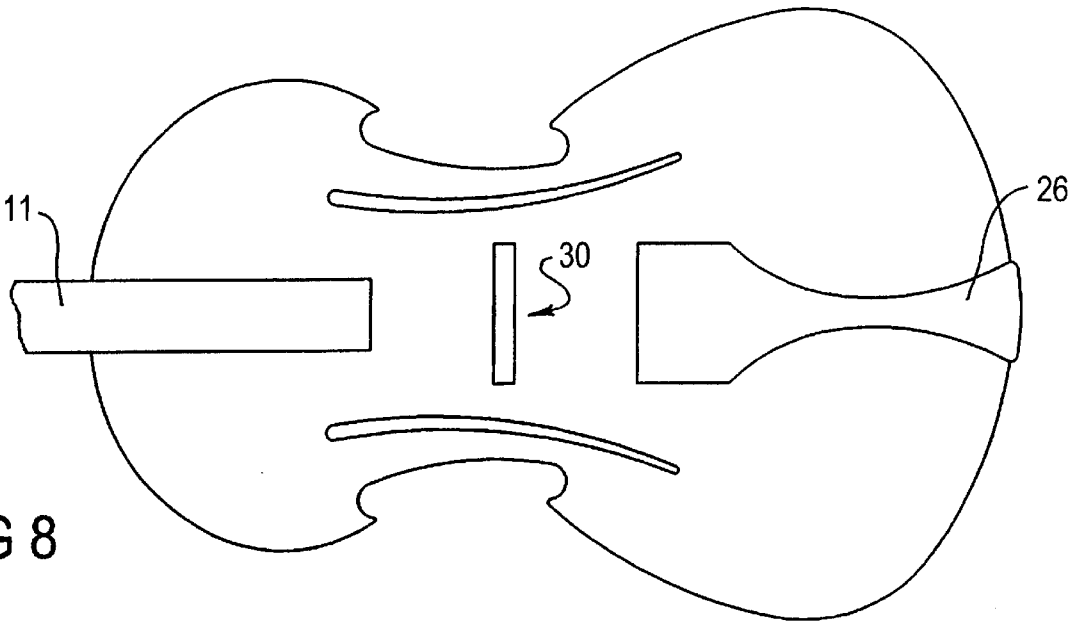

FIG. 8 is a plan view of a traditional sound box.

Figure 1:
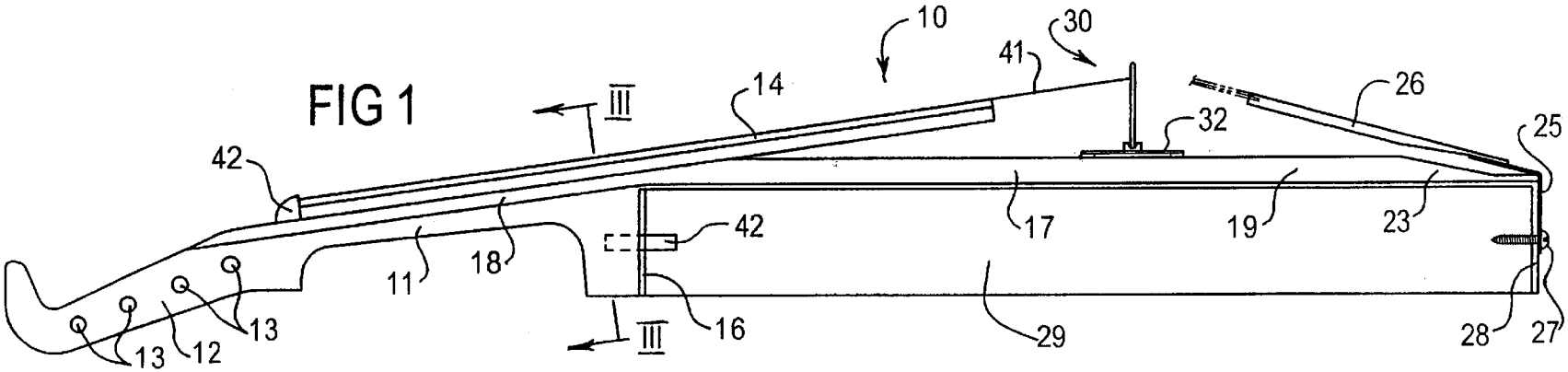

FIG. 1 shows an assembly 10 according to the invention. The assembly 10 is for a violin, and includes a neck 11 which extends to a string box 12 for anchoring of one end of the instrument strings. In accordance with traditional principles, the string box 12 includes a plurality of pegs 13 (four in the case of a violin), about which the strings are fixed and which are rotatable to alter string tension for tuning purposes.

Attached to the neck 11 is a finger board 14 and that is fixed to an upper surface 15 of the neck 11 and extends beyond the forward end 16 thereof. As shown, the finger board 14 is supported along the upper surface 15 of neck 11 and is unsupported beyond the forward end 16.

Figure 2A:
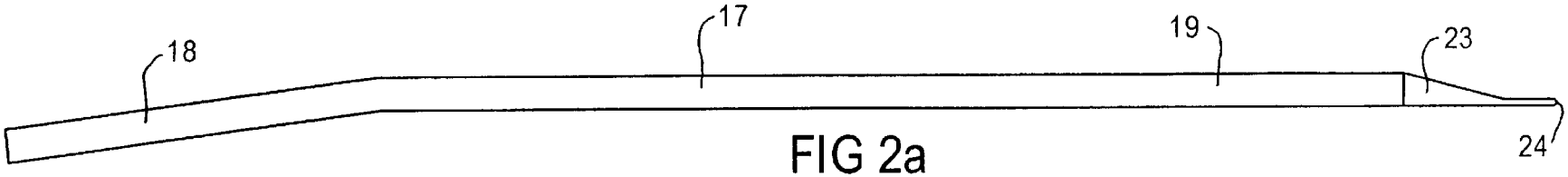

The assembly 10 further includes a structural member in the form of an elongate rod 17 (shown also in FIGS. 2*a* and 2*b*), and that rod includes a first section 18 disposed at an angle to a second section 19. The angle of disposition is approximately 8° as shown in FIG. 2*a* although that can vary. The rod 17 is preferably formed from drawn tubular aluminium and tests have shown that the optimum dimension of the rod is 10 mm OD and 8 mm ID. For those dimensions, the grade of aluminium is preferably 6060/T81. The rod may alternatively be formed from other materials, such as a plastic material which has similar characteristics. The dimensions of the member and the material selection is important, as the member will itself bend if it lacks suitable strength, or will be too heavy if it is oversized.

The rod 17 is fixed between the neck 11 and the finger board 14 within an opening 20 formed by a pair of facing channels 21 and 22 formed in facing surfaces of the neck and finger board. A cross-sectional view of this arrangement is seen in FIG. 3. The rod 17 may be fixed within the opening 20 by a suitable adhesive, or may be held within the opening by frictional engagement with the channel surfaces. It is preferable that the first section 18 of the rod 17 is assembled within the channels 21 and 22 when the finger board 14 is fixed to the neck 11, however, this assumes that in the construction of the assembly 10, the finger board 14 and the neck 11 are separately formed and are assembled together. It is possible however, that the neck and the finger board are formed in one integral unit and this, for example, may be accomplished by moulding those parts of the assembly from plastic, or casting them from metal. In those latter constructions, the opening may be formed between the neck and the finger board during formation of that integral unit by any suitable means, such as by a disposable core. Techniques for moulding and casting in this manner are well known.

It is additionally possible that the rod 17 can be formed integral with one or both of the neck 11 and/or the finger board 14 and again suitable manufacturing processes for that include moulding or casting. In a further alternative, the opening 20 may be threaded to receive a complimentary threaded end of the rod 17. In that arrangement, the threaded portion may be formed on the second section 19. Various other alterative arrangements are also possible.

Figure 2B:
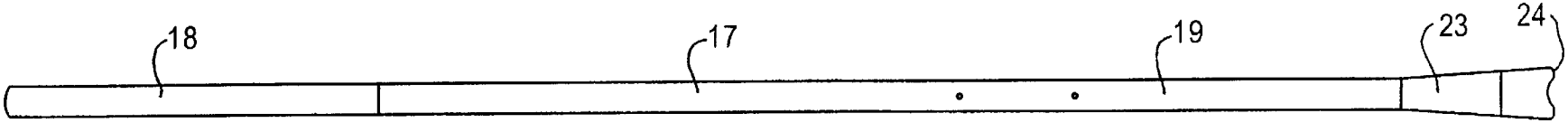

The rod 17 extends to a distal end 23, which is flattened as shown in FIG. 2*b*. The extent of the rod 17 is preferably such as to extend slightly beyond the edge of a sound box which is fitted to the assembly 10. The rear edge 24 of the rod 17 is engaged by a tail wire 25 that extends from a tail piece 26 to a tail pin 27. The tail wire 25 may be received within a groove in the rear edge 24 to locate the tail wire relative to the rear edge.

The tail pin 27 is received within an opening formed either in a depending member 28 that depends from the distal end 23 of the rod 17, or in an opening formed in the side wall of a sound box which is to be positioned within the recess 29 defined between the forward end 16 of the neck 11 and the second section 19 of the rod 17.

Figure 5:
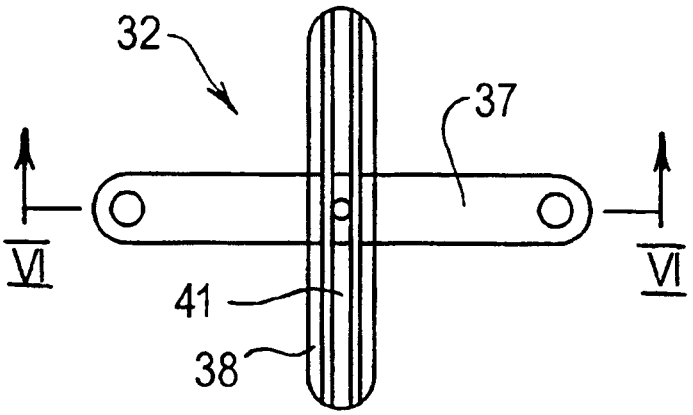
FIG. 5 is a plan view of a second part of a bridge according to the invention.
Figure 6:
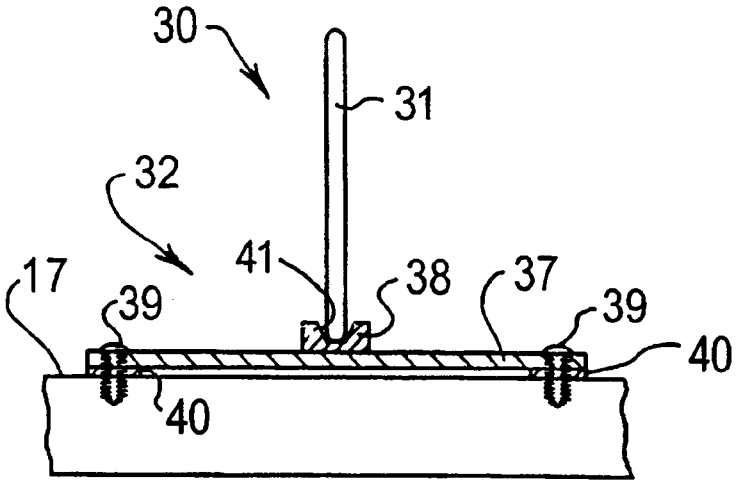
FIG. 6 is a side view of the bridge part of FIG. 5.

Intermediate of the second section 19 is a bridge 30. The bridge 30 can take any suitable configuration and a preferred embodiment is shown in FIGS. 4 to 6. The bridge 30 shown in these figures comprises two parts, namely a first part 31 shown in FIG. 4, and a second part shown in FIGS. 5 and 6. The first and second parts 31 and 32 are arranged to be assembled together in a pivotal manner.

Referring first to FIGS. 4*a* and 4*b*, a first part 31 is shown and this includes a string supporting surface 33 provided with four grooves 34 for locating the strings of the instrument thereto. The surface 33 is arcuately curved to displace the strings vertically. The part 31 further includes a pair of side edges 35 that extend from the surface 33 to a bottom surface 36. The side edges 35 are shown as straight edges, although these can equally be curved or otherwise shaped. The bottom edge equally can be curved and it is preferred that a section of the bottom edge between a portion inwardly of the junction with the side edges 35, be relieved inwardly, preferably in a concave form. A bottom edge formed in that manner is likely to transmit the string vibrations in a manner to produce a sound of high quality for reasons which will become apparent hereinafter. The first part 31 can also include decorative features as shown, which is a feature of such violin components.

The second part 32 is shown in one embodiment in FIG. 5. FIG. 5, is a plan view of the second part 32, while FIG. 6 shows a cross-sectional view through AA of FIG. 5. The second part 32 includes a fixing member 37 which underlies a supporting rail 38. The fixing member 37 is arranged for connection to the rod 17 of FIG. 1 and the connection can be made in any suitable manner such as by a screw fastener, rivet, or adhesive. The connection of the fixing member 37 to the rod 17 is shown more clearly in FIG. 6. In that figure, the fixing member 37 is fixed to the rod 17 by screw fasteners 39, with damping pads 40 interposed between the member 37 and the rod 17. The damping pads 40 minimise the transfer of vibration through the rod 17 to the bridge 30.

The supporting rail 38 is fixed to the fixing member 37, again by any suitable means such as mechanical fasteners or adhesives and includes a channel 41 extending across the supporting rail 38. The channel 41 is of a width and depth suitable to receive the bottom surface 36 of the first part 31 therein and to facilitate pivotal movement of the first part 31 relative to the second part 32 as necessary.

While it is not shown in the drawings, each end of the supporting rail 38 includes a foot extending from an underneath surface thereof for engagement with the top plate of a sound box. One of the feet is preferably located over the sound post located internally of the sound box and the arrangement between the feet of the supporting rail 38 and the sound post can be the same as that described in applicants' Australian patent number 662306, the specification of which is incorporated herein by cross-reference. The other foot may be located over the bass bar as also described in the above Australian patent.

The arrangement of FIGS. 5 and 6 is such as to facilitate pivotal movement of the first part 31 relative to the second part 32 and rotational or rocking movement about the longitudinal axis of the supporting rail 37 by virtue of the flexible nature of the damping pads 40. The movement about the axis of the fixing member 37 is not essential and can be substantially or fully eliminated as necessary by the manner in which the fixing member is attached to the rod 17. The pivotal movement of the first part 31 within the channel 41 of the second part 32 is however essential to this aspect of the invention, although the degree of pivoting movement may only be small. The movement is divided between static movement that occurs when the strings require adjustment, and dynamic movement when the violin is being played. Static movement may be in the order of 5° to 6° in either direction longitudinal of the strings, while dynamic movement is relatively negligible unless a greater than normal force is applied to the strings.

Referring now to FIG. 1, the bridge 30 is shown, with the first part 31 upstanding from the second part 32. In that arrangement, the strings 41 extend from the string box 12, over an abutment 42 and to the string supporting surface 33 of the bridge 30. The strings then extend to the tail piece 26 to which they are anchored. As previously discussed, a tail wire 25 extends from the tail piece 26 to a tail pin 27, that fixes the strings in tension. The string tension forces the first and second parts of the bridge 30 into engagement, but that engagement facilitates pivotable movement of the first part 31 relative to the second part 32 as necessary depending on the tension in the strings.

While the bridge 30 shown in FIG. 1 is of the same construction as that of FIGS. 5 and 6, this aspect of the invention is not limited to an arrangement of that kind but also extends to a bridge which can be applied to a violin having a traditional construction. Such a bridge 32' is shown in FIGS. 7*a* and 7*b*. In these figures, only the second part of a bridge is shown and it can be assumed that a first part of the kind shown in FIGS. 4*a* and 4*b* is applicable to the second part 32' of the bridge shown in FIGS. 7*a* and 7*b*. The second part 32' includes a supporting rail 43 and a pair of feet 44. The lowermost surfaces of the feet 44 are constructed to sit flush against the upper surface 45 of the top plate of a sound box and the second part 32' may be maintained in this position by string pressure acting through the first part 31, or they may be fixed to the top plate by adhesive or mechanical fasteners, including recesses into which the feet are fitted.

The second part 32' includes a channel 46 extending lengthwise across the supporting rail 43 and that channel 46 can be seen in cross-section in FIG. 7*b*. The channel 46 extends fully across the supporting rail 43 and is of a width and depth suitable to receive the bottom surface 36 of the first part 31 therewithin so that the first part 31 is upstanding from the second part 32' and facilitates pivotal movement of the first part 31 relative to the second part 32'. The bridge 32' can be formed from traditional timber materials, or from other materials which may for example, be cast or moulded.

The assembly 10 of FIG. 1 facilitates attachment of a sound box thereto and the sound box can be of a traditional form, such as that shown in plan view in FIG. 8, or may take an alternative and less traditional form. In this respect, the use of an assembly according to the invention promotes the use of a modified sound box, which has a less complex construction compared to traditional sound boxes. Such a box may have a belly or top plate which is generally planar, as compared to traditional top plates which are formed with a somewhat arcuate curvature. Thus, the modified sound box does not require the complicated and time consuming procedures necessary to impart that curved configuration. Such traditionally formed sound boxes are shown in applicant's Australian Patent No. 662306 which is incorporated herein by cross-reference. The arrangement disclosed in that patent is however also applicable to the present invention and in particular, that patent discloses the provision of an opening in the top plate of the sound box, for extension of a sound post. It is within the scope of the present invention to employ such a sound box with the assembly and/or the bridge disclosed herein.

In FIG. 1, the sound box is fitted to the assembly 10 by way of the tail pin 27 extending through the depending member 28 and into an opening formed in the wall of the sound box adjacent the tail pin, and a dowel 47 which extends from the forward end 16 of the neck 11 and into an opening in the adjacent wall of the sound box. Alternatively, openings of that kind may not be formed in the wall of the sound box, but instead, bushes may be fixed to extend from the wall and to provide openings for receipt of the tail piece 26 and dowel 47. Other alternative fitting arrangements are also possible and the arrangement may be such as to permanently fit the sound box within the assembly. Thus, the sound box may be adhesively connected to the neck 11 and the depending member 28, or otherwise fastened in a permanent manner.

In the alternative, the depending member 28 may be a wall of the sound box and engagement of the tail pin 27 with the sound box in the appropriate manner may result in the strings being tensioned. In that arrangement, removal of the sound box from the assembly 10 will result in the strings being slackened unless the tail wire or tail piece are maintained in a tensioned manner.

The assembly of the invention may be provided with or without any one of the strings, the bridge or the sound box. In the broadest sense, the assembly includes nothing more than the neck and the structural member, although in a preferred arrangement, at least a suitable bridge is also provided.

The invention described herein is susceptible to variations, modifications and/or additions other than those specifically described and it is to be understood that the invention includes all such variations, modifications and/or additions which fall within the spirit and scope of the above description.

What is claimed is:

1. An assembly for a stringed musical instrument, said assembly including an elongate neck to which one end of a string arrangement of the instrument can be anchored and a structural member depending from said neck, said structural member being substantially aligned with the lengthwise extent of said neck and extending in the opposite direction thereto so as to overlie a sound box to which in use, the assembly is connected, and being arranged to cooperate with and to bear string tension load of a string arrangement applied to said assembly, wherein said neck includes an opening suitable to receive and locate one end of said structural member.

2. An assembly according to claim 1, wherein said structural member is elongate and is arranged in use, to extend from said neck to adjacent the end of the sound box remote from said neck.

3. An assembly according to claim 1, wherein said structural member is a rod of solid or tubular form.

4. An assembly according claim 1, wherein said structural member is highly rigid and lightweight.

5. An assembly according to claim 1, where in use, said structural member is arranged to extend across the sound box in a plane substantially parallel to the general plane of a top plate of the sound box.

6. An assembly according to claim 1, wherein the neck supports a finger board and the facing surfaces of the neck and the finger board each include a channel that, when assembled, in facing relationship, form said opening.

7. An assembly according to claim 1, wherein said one end of said structural member is fixed within said opening by an adhesive.

8. An assembly according to claim 1, wherein said one end of said structural member is threadably engaged within said opening.

9. An assembly according to claim 1, wherein said neck includes a finger board formed integrally therewith.

10. An assembly according to claim 9, wherein said structural member is formed integrally with said neck and said fingerboard.

11. An assembly according to any one of claim 1, wherein said neck extends at an angle to the sound box and said structural member includes a locating portion for locating the structural member relative to the neck, which locating portion extends substantially the same said neck angle from the remaining portion of the structural member.

12. An assembly according to claim 1, wherein in use, said structural member, remote from the connection to said neck, includes facility for engagement thereof with the string arrangement of the instrument in order for said structural member to bear string tension.

13. An assembly according to claim 12, wherein said facility is arranged for attachment of said string arrangement thereto.

14. An assembly according to claim 12, wherein said string arrangement is connected to said structural member by a pin.

15. An assembly according to claim 1, including a sound box attached thereto.

16. An assembly according to claim 1, including a string arrangement attached thereto.

17. An assembly according to claim 16, wherein said sound box is releasably attached to said assembly.

18. An assembly according to claim 1, including a bridge for supporting strings of said string arrangement above said sound box.

19. An assembly according to claim 18, said bridge extending laterally on either side of said structural member and said member in use, extending adjacent one of the lateral extremities thereof in contact with a top plate of the sound box and adjacent the other of the lateral extremities in contact with a bottom plate of the sound box via a sound post extending through an opening in the top plate.

20. An assembly according to claim 18, said bridge including a member which is fixed to said structural member longitudinally thereof in a manner which facilitates vertical and torsional movement of the bridge, said member extending laterally on either side of said structural member and said member in use, extending adjacent one of the lateral extremities, thereof in contact with the top plate of the sound box and adjacent the other of the lateral extremities in contact with the bottom plate of the sound box via a sound post extending through an opening in the top plate.

21. An assembly according to claim 20, said member including a laterally extending groove for pivotably supporting an upstanding member that extends into engagement with the strings of said string arrangement.

22. An assembly according to claim 18, said bridge including a pair of feet and the arrangement of the structural member and the bridge being such that the bridge is partly supported by said structural member and partly by engagement with said feet against the top plate of the sound box.

23. An assembly according to claim 18, wherein said structural member is an elongate rod and said bridge includes a first member fixed to the rod in the longitudinal direction thereof and a second member which is fixed to or integral with the first member in a direction substantially perpendicular thereto and which is arranged in use, to engage the top plate of the sound box, said second member being arranged for pivotable engagement by a third member which is upstanding from the second member and which includes a string supporting surface remote from said engagement with said second member, for supporting the strings of a string arrangement.

24. A stringed musical instrument according to claim 1 any one wherein said instrument is a violin or a cello or a double base.

* * * * *